US012139911B1

(12) United States Patent
Lopes

(10) Patent No.: US 12,139,911 B1
(45) Date of Patent: Nov. 12, 2024

(54) METHOD OF MAKING METAL PANELS FOR BUILDINGS

(71) Applicant: Luciano Simoes Lopes, Doral, FL (US)

(72) Inventor: Luciano Simoes Lopes, Doral, FL (US)

( * ) Notice: Subject to any disclaimer, the term of this patent is extended or adjusted under 35 U.S.C. 154(b) by 0 days.

(21) Appl. No.: 18/499,685

(22) Filed: Nov. 1, 2023

(51) Int. Cl.

| | |
|---|---|
| ***E04C 2/288*** | (2006.01) |
| ***E04B 2/00*** | (2006.01) |
| ***E04C 2/292*** | (2006.01) |
| ***E04C 2/34*** | (2006.01) |

(52) U.S. Cl.
CPC ..... *E04C 2/3405* (2013.01); *E04C 2/288* (2013.01); *E04C 2/292* (2013.01); *E04C 2/46* (2013.01); *E04C 2002/3488* (2013.01)

(58) Field of Classification Search
CPC ..... E04C 2/3405; E04C 2/288; E04C 2/292; E04C 2/46
See application file for complete search history.

(56) References Cited

U.S. PATENT DOCUMENTS

| | | | | |
|---|---|---|---|---|
| 6,568,144 | B2 * | 5/2003 | Meredith | E04B 1/08 52/656.1 |
| 2005/0155322 | A1 * | 7/2005 | Kroie | E04B 2/825 52/782.1 |
| 2013/0305643 | A1 * | 11/2013 | Singleton | E04C 2/284 52/404.1 |

* cited by examiner

*Primary Examiner* — Jason L Vaughan
*Assistant Examiner* — Amanda Kreiling
(74) *Attorney, Agent, or Firm* — Ruben Alcoba, Esq.

(57) ABSTRACT

A method of making a metal frame that will be used to make metal panels that will be used to fabricate modular metal buildings. Currently, the metal frames are manufactured through forming processes, however, the steps adopted end up generating greater difficulty in the conformation of the metal sheet, and, consequently, increase in the manufacturing time; as well as, they cannot achieve a higher degree of quality, which reduces the added value of the metal frame and can lead to greater difficulty of assembly, lower productivity and higher labor cost. The ideal method, comprises of modular plates (1) that are formed by galvanized sheet frames (2), which are manufactured by the method with 22 forming steps through a roll forming machine (7) with profiling rolls (9) with specific frames (10), and each step has a roll (9) and a set of support rollers (12) for each forming step.

6 Claims, 20 Drawing Sheets

FIG. 02
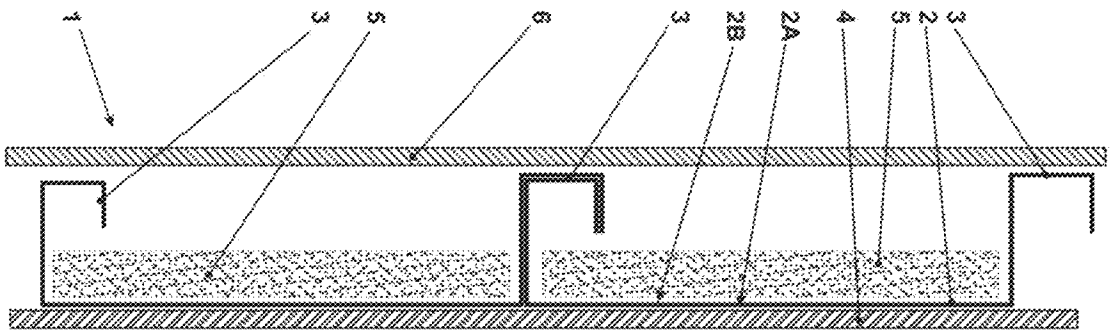
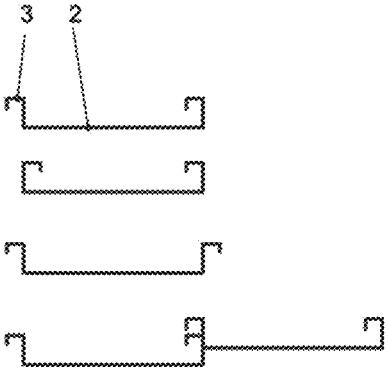
FIG. 03

METHOD OF MAKING METAL PANELS FOR BUILDINGS

BACKGROUND

The invention is directed to a method of making metal panels for buildings.

The present invention is a method that enables a faster and more efficient way of fabricating the metal frames that are used to make metal panels.

Presently, there are several methods of making metal frames using industrial machines. In a typical method, a metal roll is fed into a machine, the metal fed into the machine if folded, and lastly the metal folded is cut to a required size by the machine.

Currently, the metal frames are manufactured through a forming process, however, the manufacturing steps currently adopted end up generating a greater difficulty in the conformation of the metal sheet, and consequently, an increase in the total processing time of the metal frame.

The metal frames used in making the metal panels need to be manufactured with precision, for the metal frames must be fitted together properly to ensure the structural integrity of the building. The proper fitting of the metal frames prevents problems that are related to the rigidity and thermo-acoustic insulation of the building.

Methods currently used in the industry do not achieve a superior metal frame that will maximize productivity in the field of building construction. Productivity is reduced when metal frames are not fabricated correctly.

The intention of the present invention is to provide a method of making a metal frame that will be used to make metal panels that will be used to fabricate modular metal buildings. The present invention provides a method of making metal frames that will reduce the manufacturing time and the costs associated with making the metal frames. The metal frames created are of a higher quality of production, for they are more standardized. The metal frames produced are standardized to fit together when connected, thereby increasing the structural integrity of buildings made using the metal panels that use the metal frames.

SUMMARY

The present invention is directed to a method of making a metal frame that will be used to make metal panels that will be used to fabricate modular metal buildings.

An object of the present invention is to provide a method of manufacturing metal frames that will reduce the cost of production.

Another object of the present invention is to provide a method of manufacturing metal frames that will be more standardized.

Yet another object of the present invention is to provide metal panels, that use the metal frames that are fabricated using the present method of making the metal frames, that will result in the building of stronger modular metal buildings.

Yet still another object of the present invention is to provide metal frames that will be easy to assemble due to their standardization.

BRIEF DESCRIPTION OF THE ATTACHED DRAWINGS

These and other features, aspects, and advantages of the present invention will become better understood with regards to the following description, appended claims, and drawings where:

FIG. 2 shows a side view of a wall composed of the metal panels of the present invention (1);

FIG. 3 shows a variation of possible side views of the metal frames (2) components of metal panels (1), as well as some variations of the fittings (3) of the metal frames (2);

Figure 4:
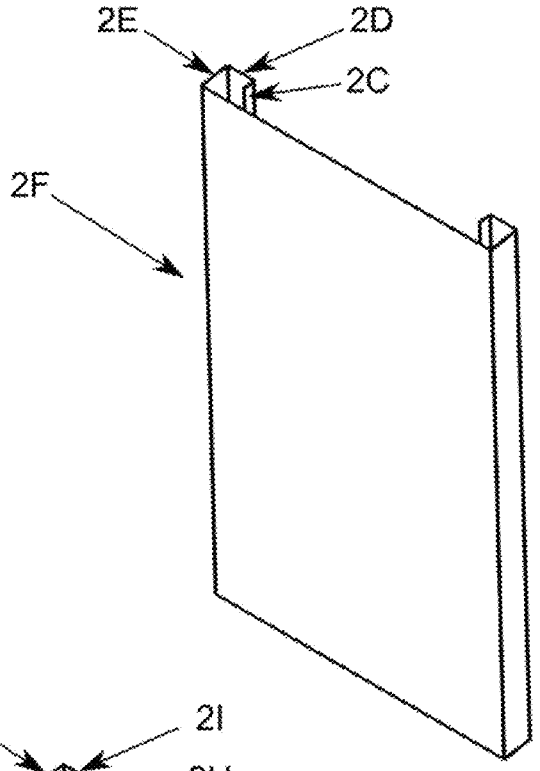
FIG. 4 is a perspective view of a first closed metal frame (2F) fixed in the metal panel (1)
Figure 5:
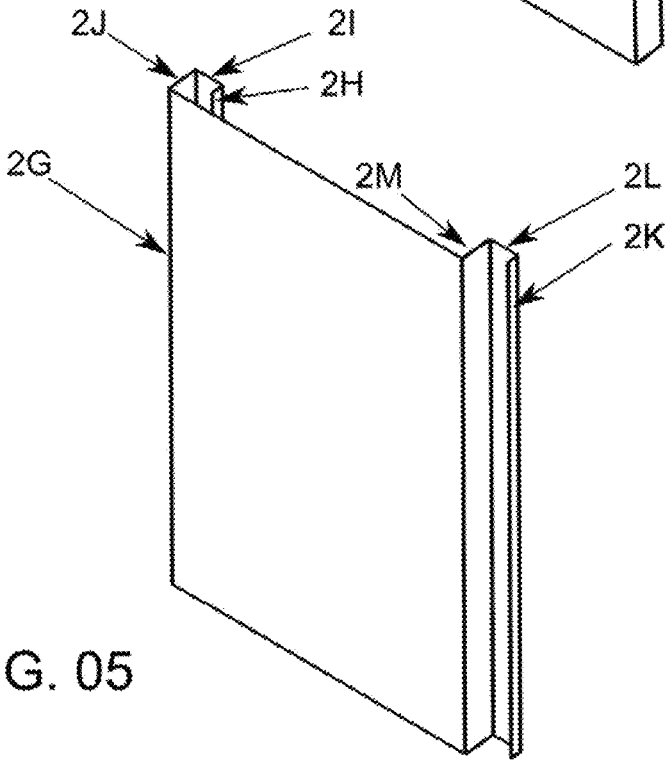
Figure 6:
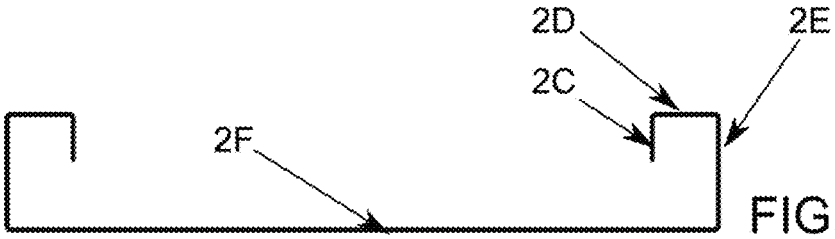
Figure 7:
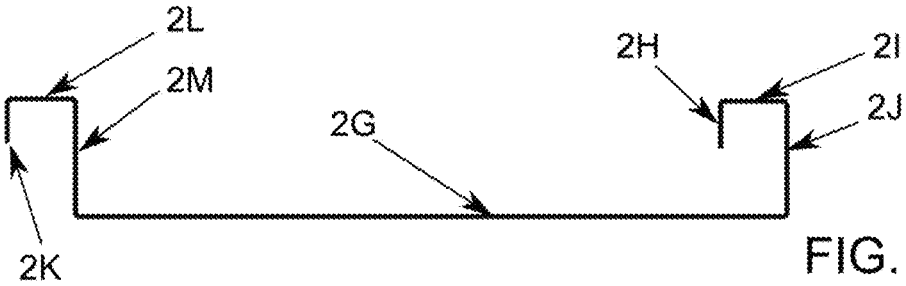
Figure 8:
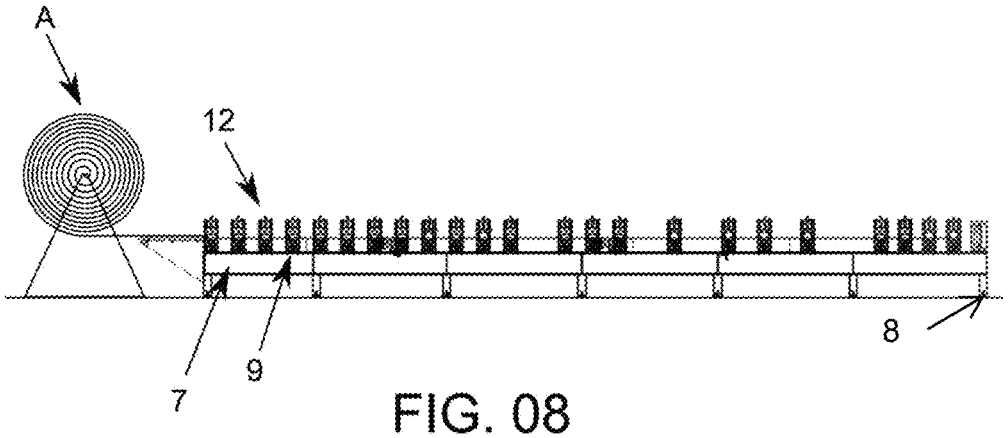
Figure 9:
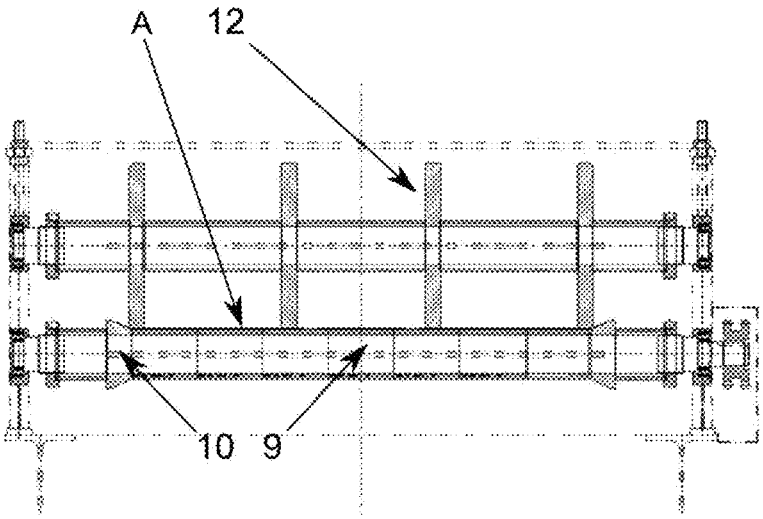
Figure 10:
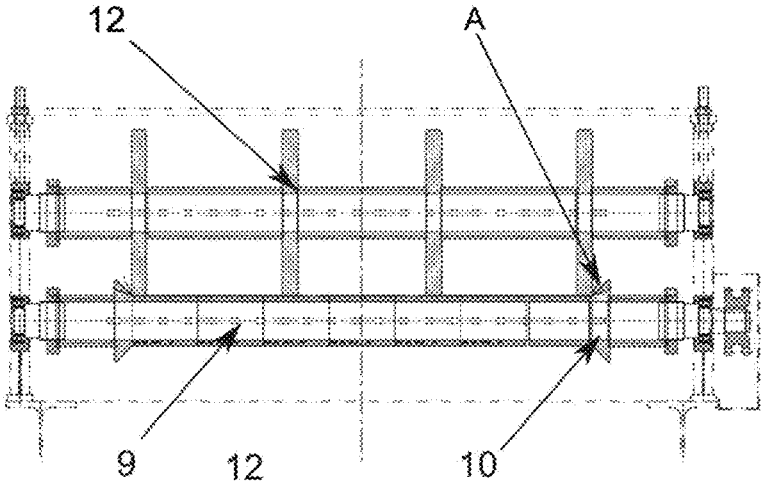
Figure 11:
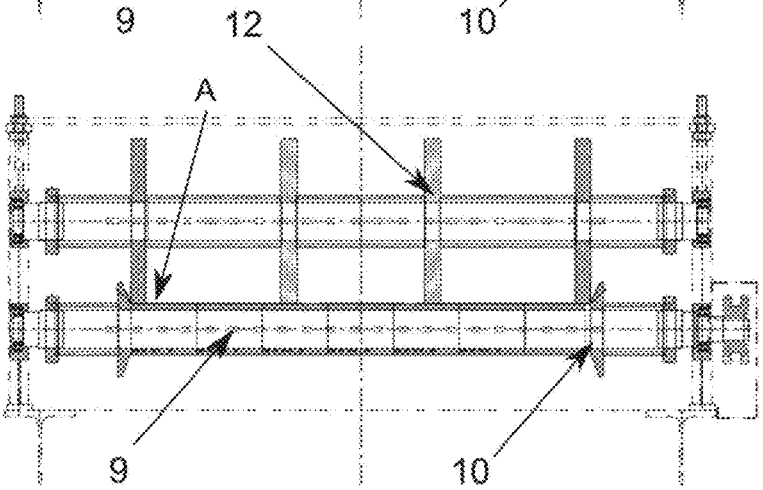
Figure 12:
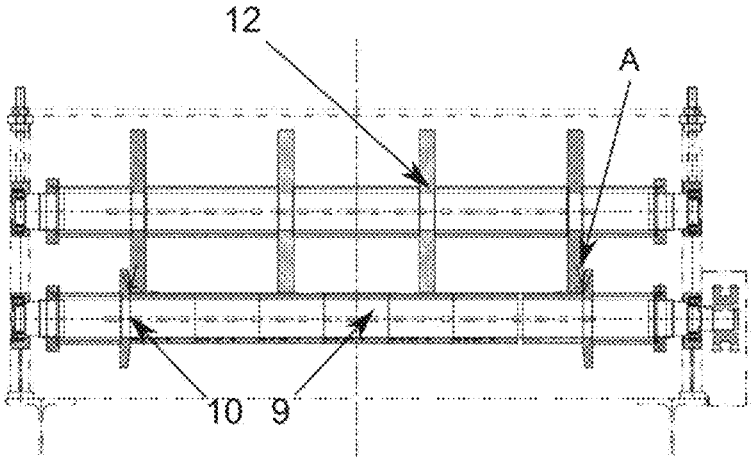
Figure 13:
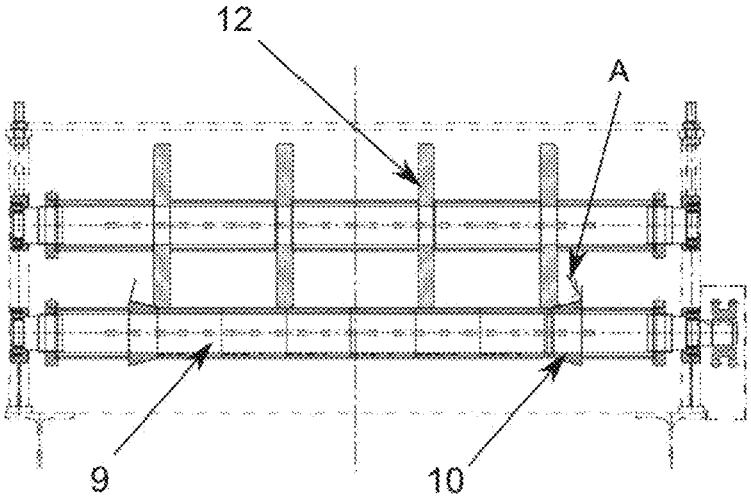
Figure 14:
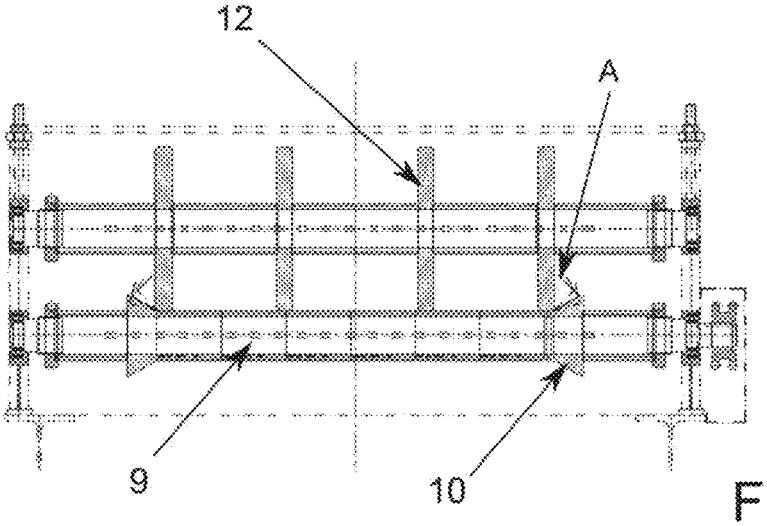
Figure 15:
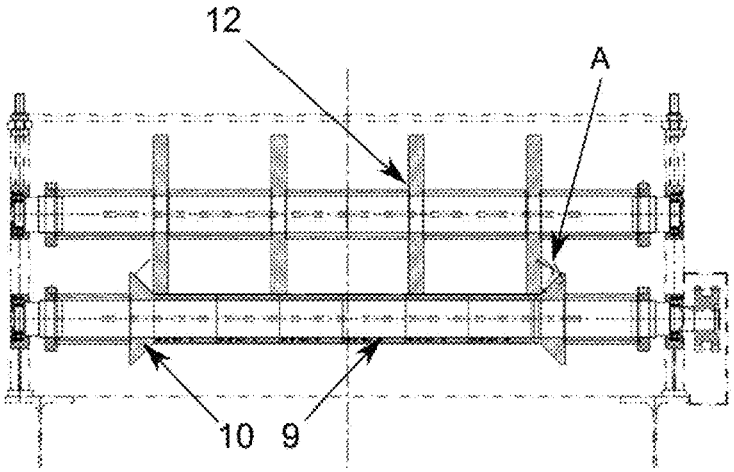
Figure 16:
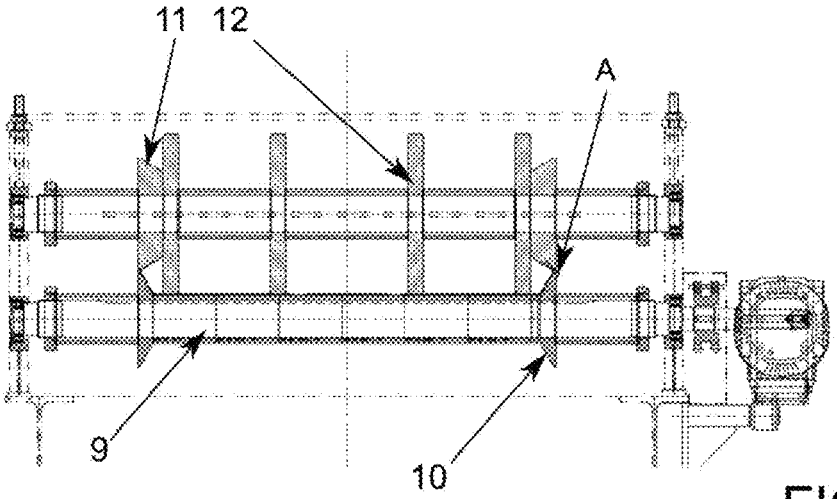
Figure 17:
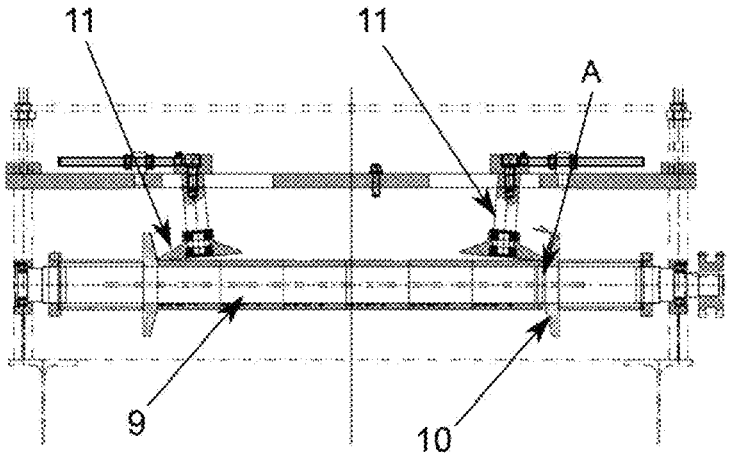
Figure 18:
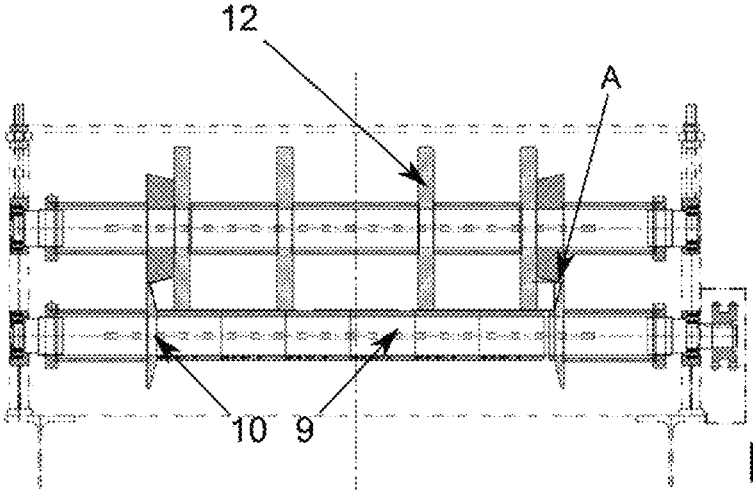
Figure 19:
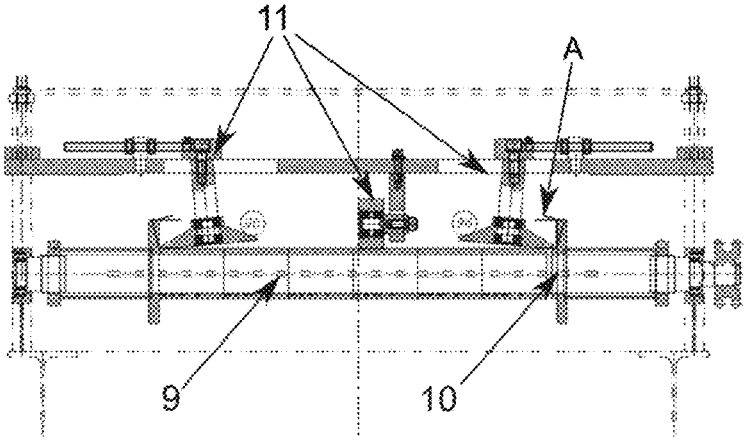
Figure 20:
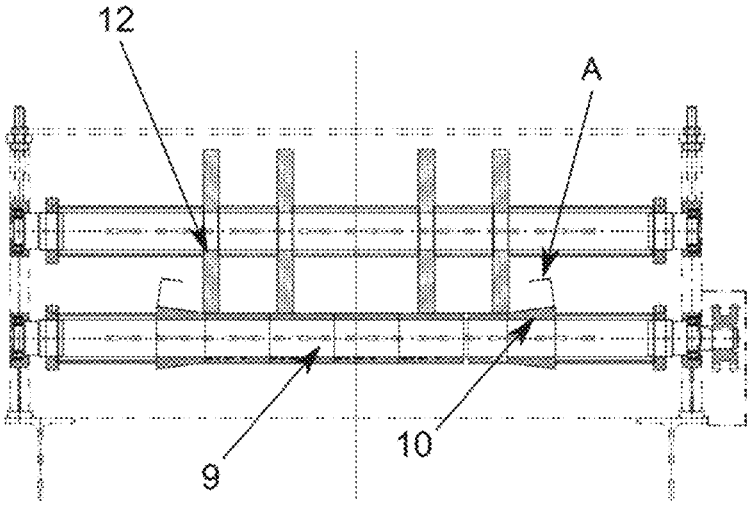
Figure 21:
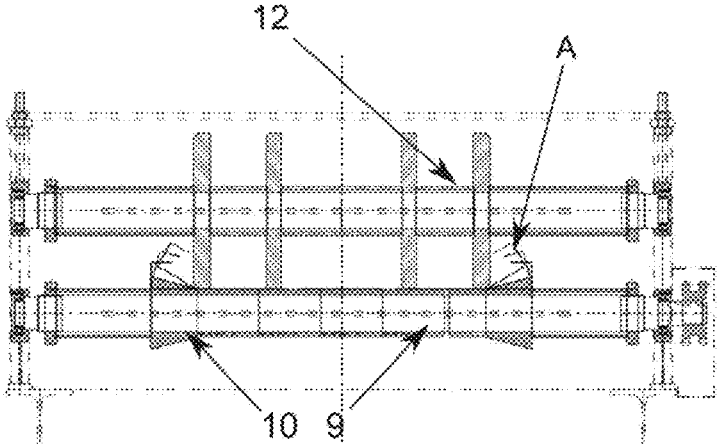
Figure 22:
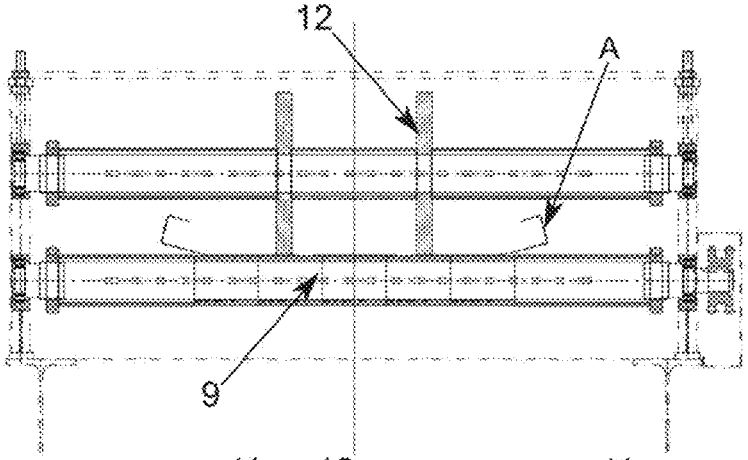
Figure 23:
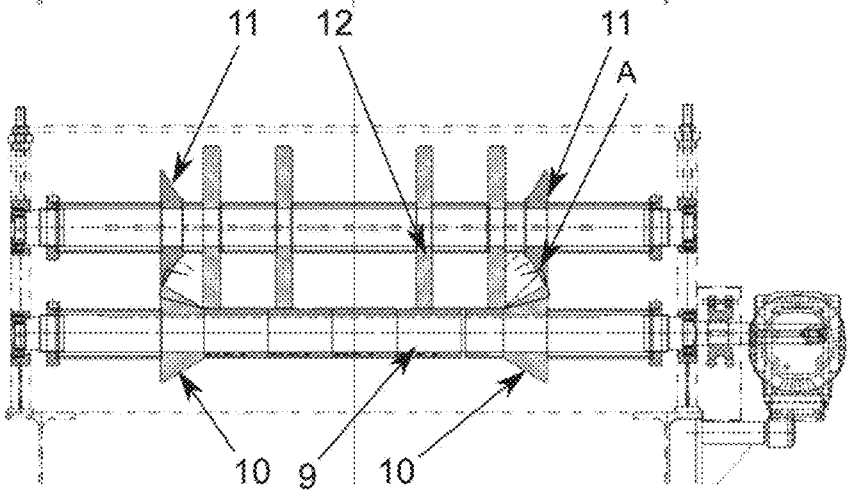
Figure 24:
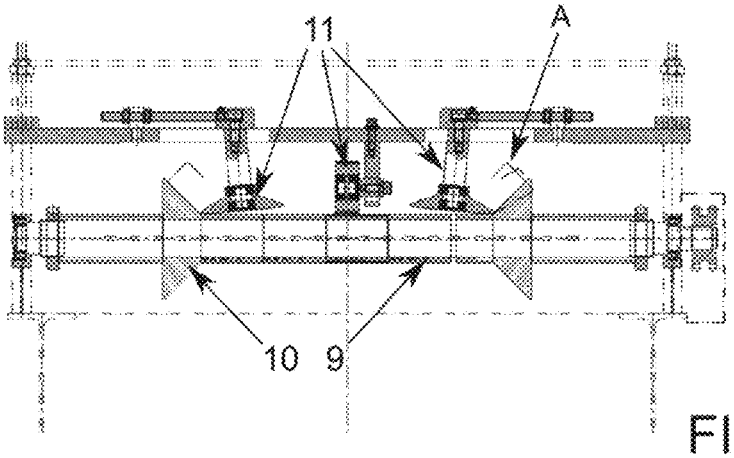
Figure 25:
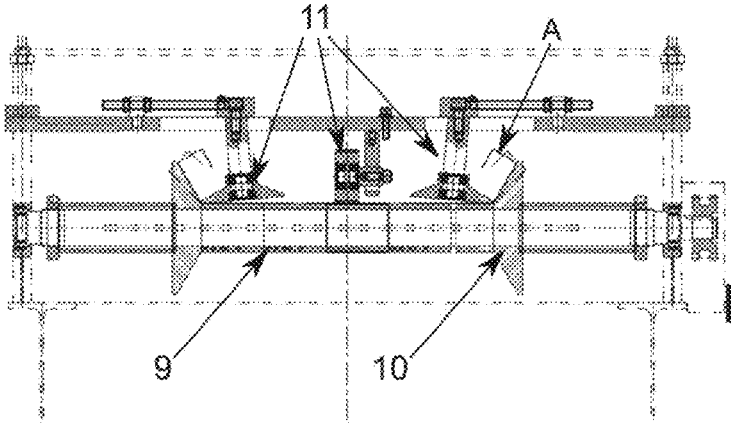
Figure 26:
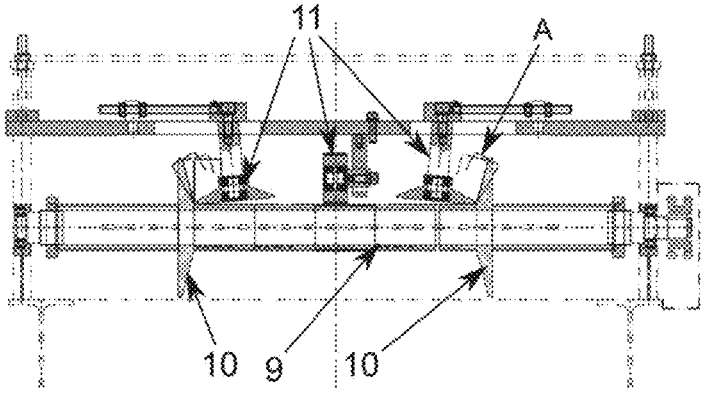
Figure 27:
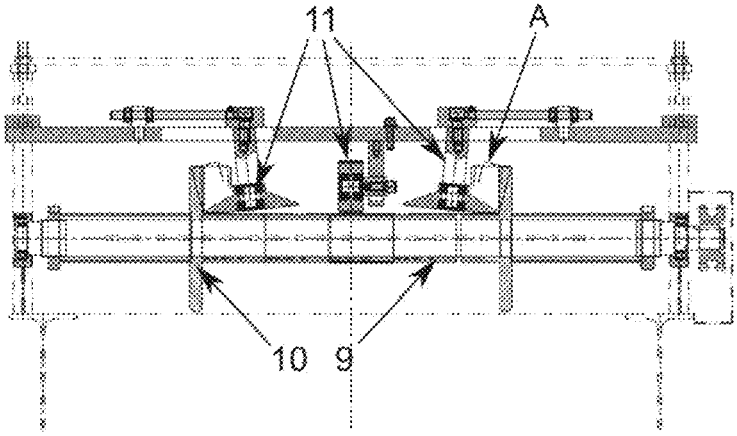
Figure 28:
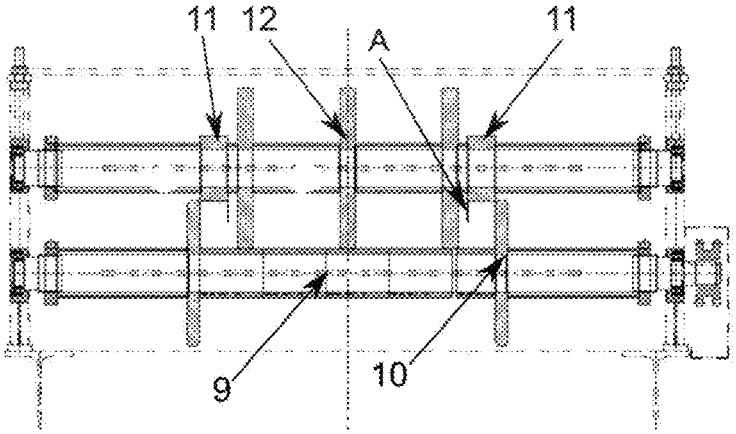
Figure 29:
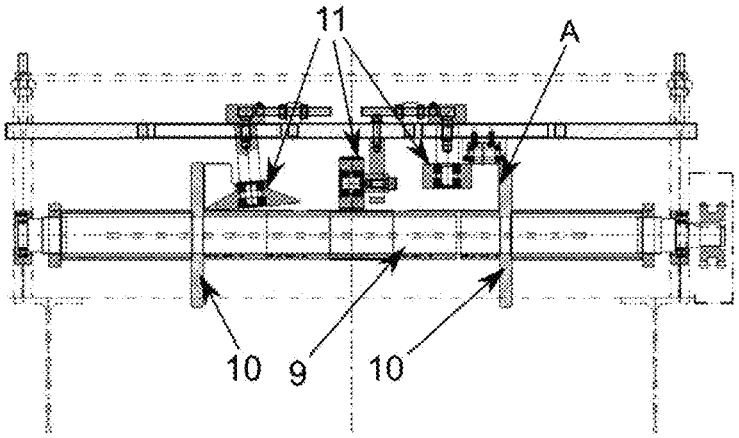
Figure 30:
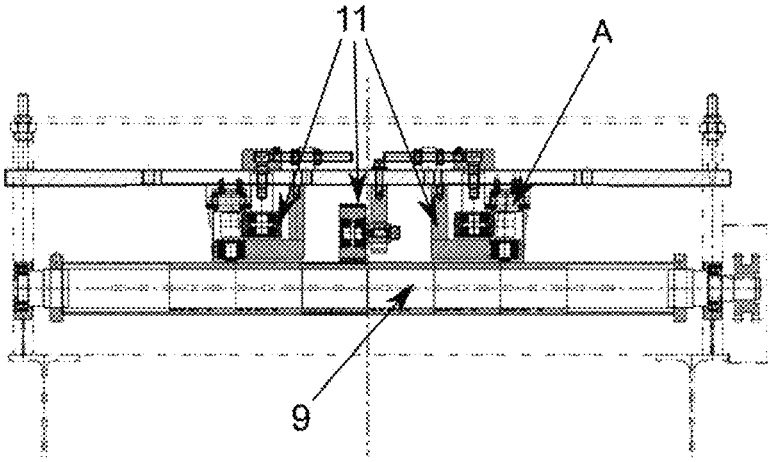
Figure 31:
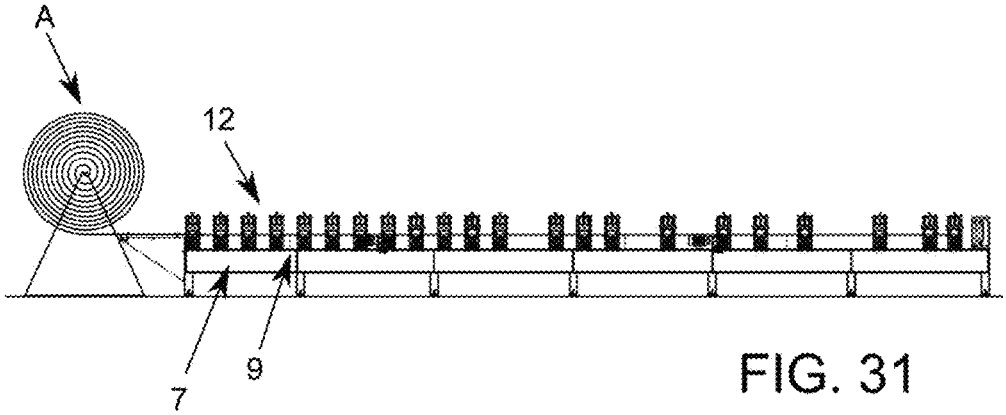
Figure 32:
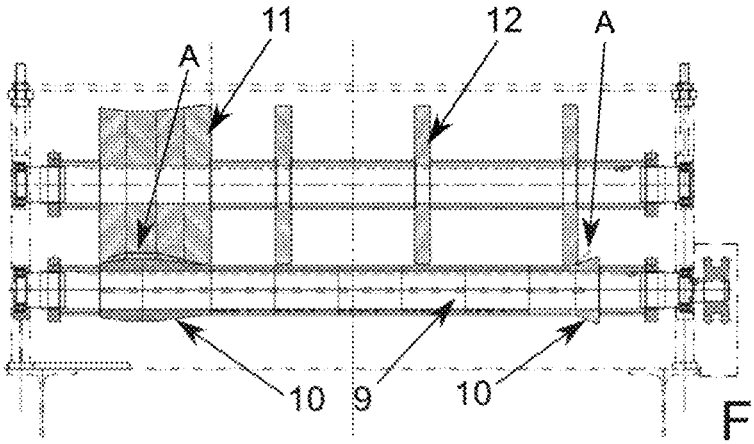
Figure 33:
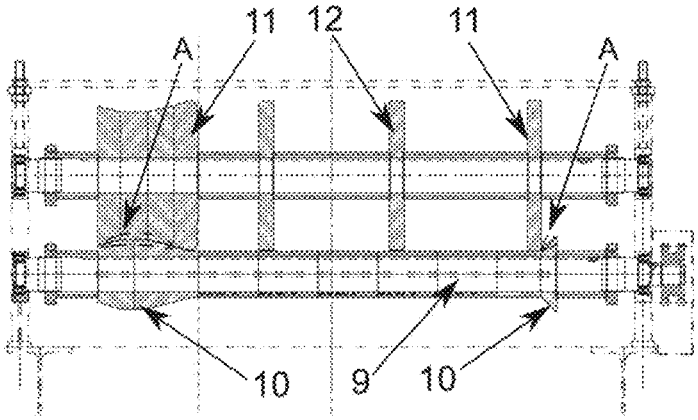
Figure 34:
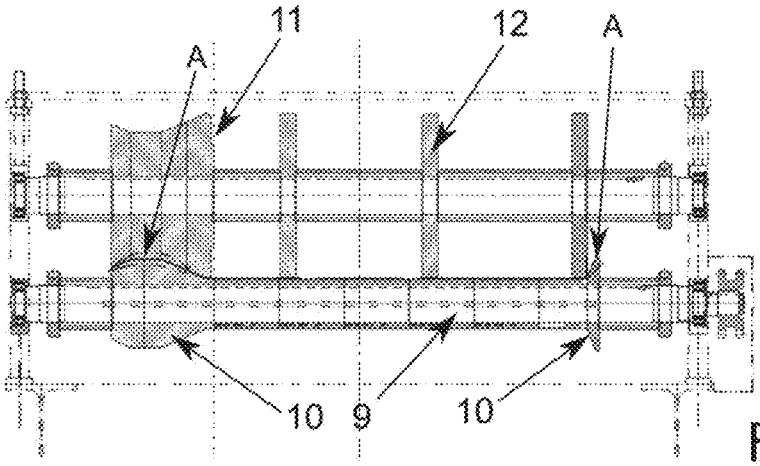
Figure 35:
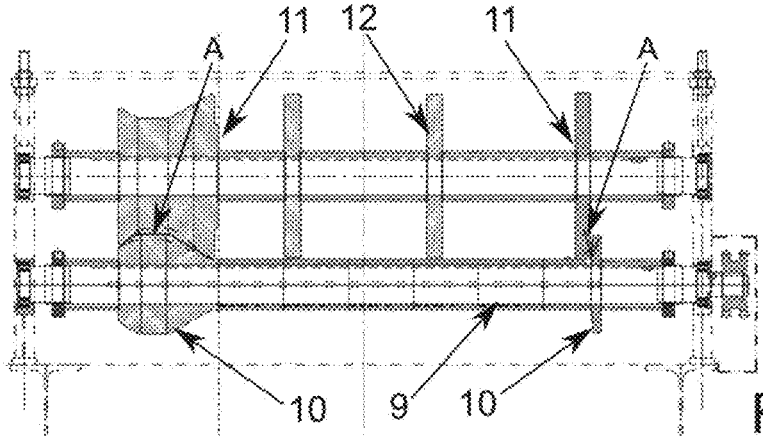
Figure 36:
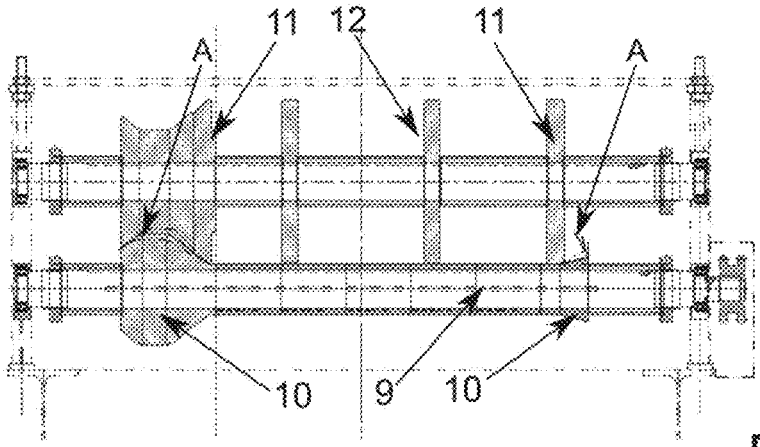
Figure 37:
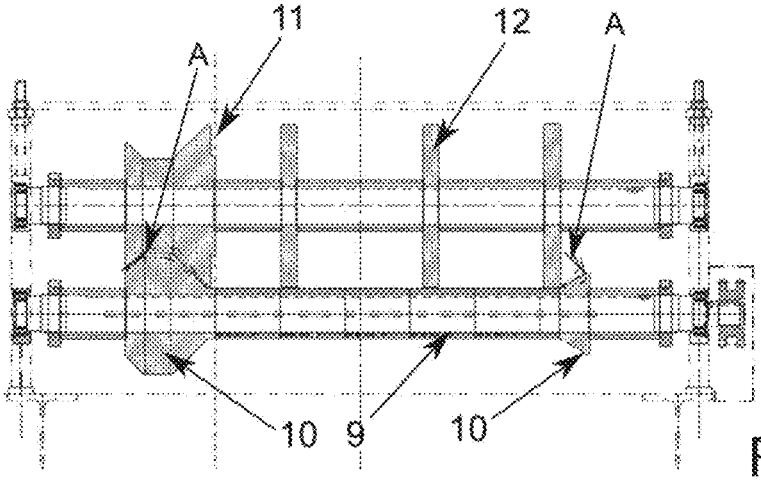
Figure 38:
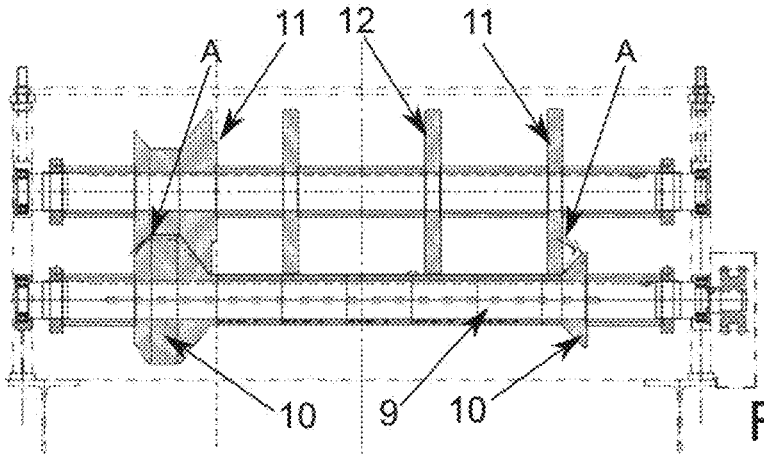
Figure 39:
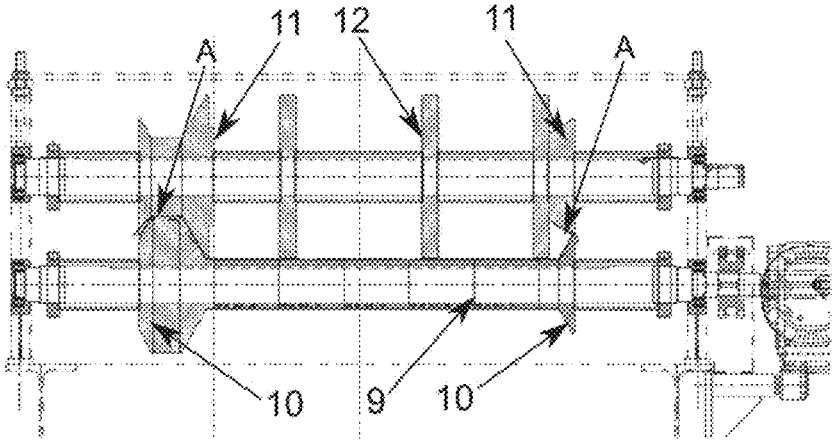
Figure 40:
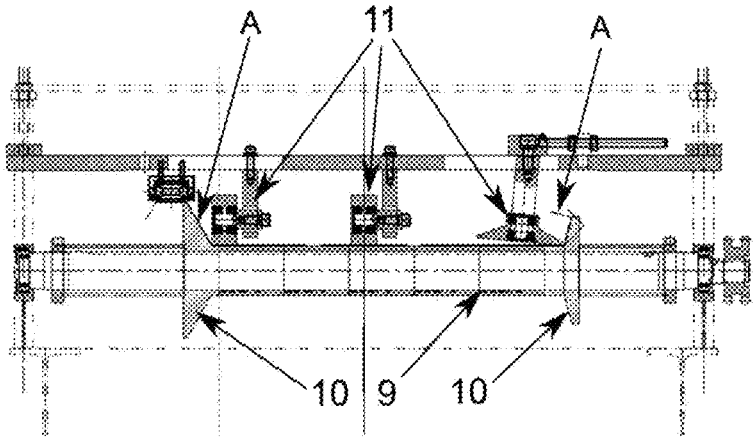
Figure 41:
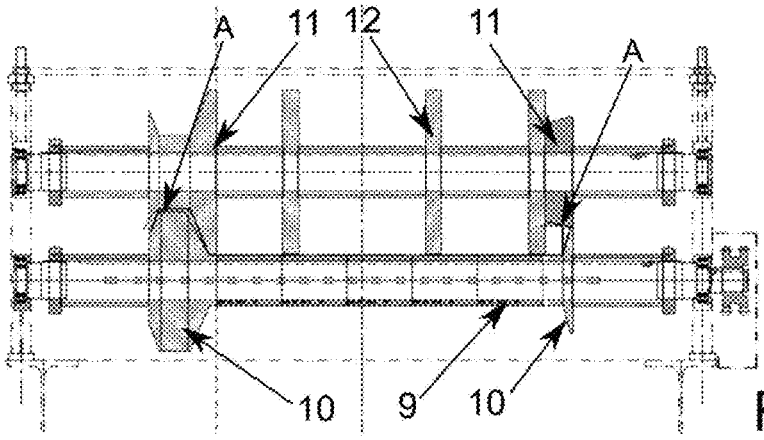
Figure 42:
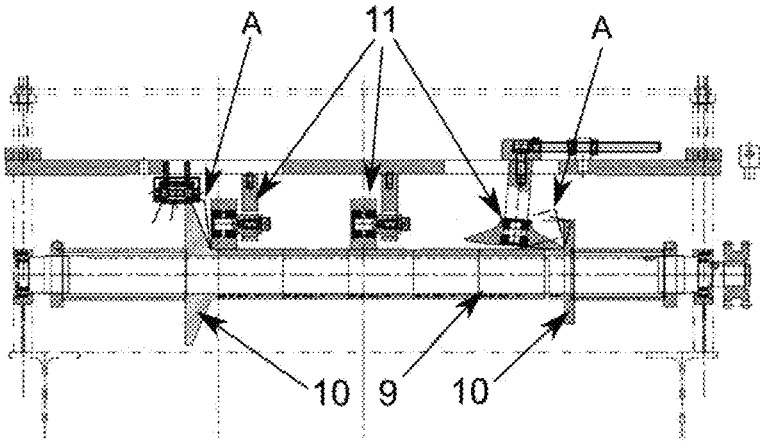
Figure 43:
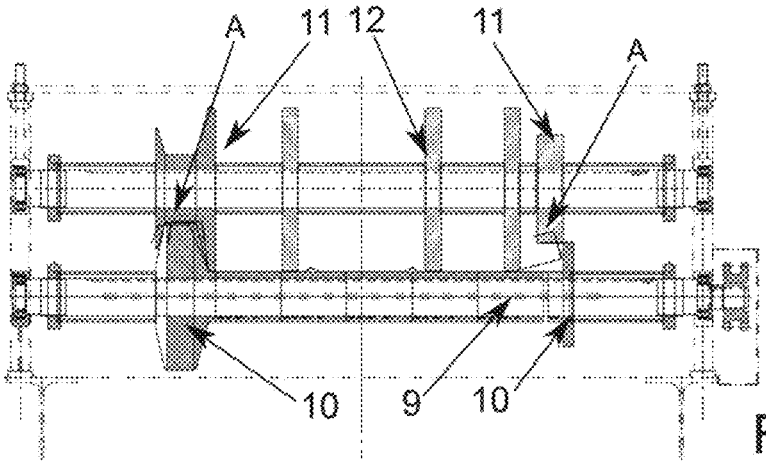
Figure 44:
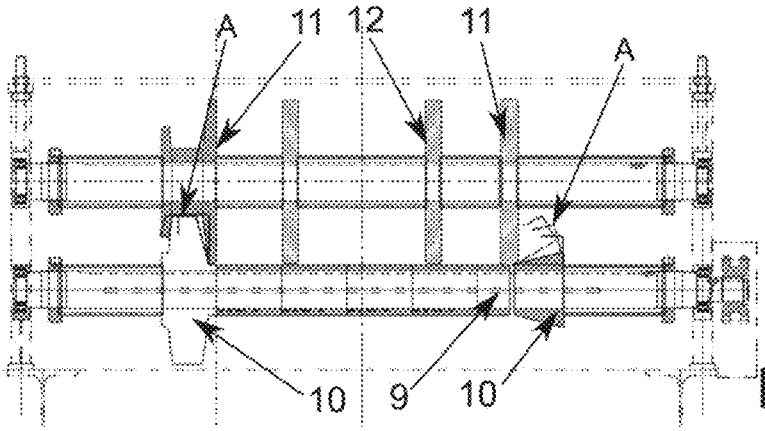
Figure 45:
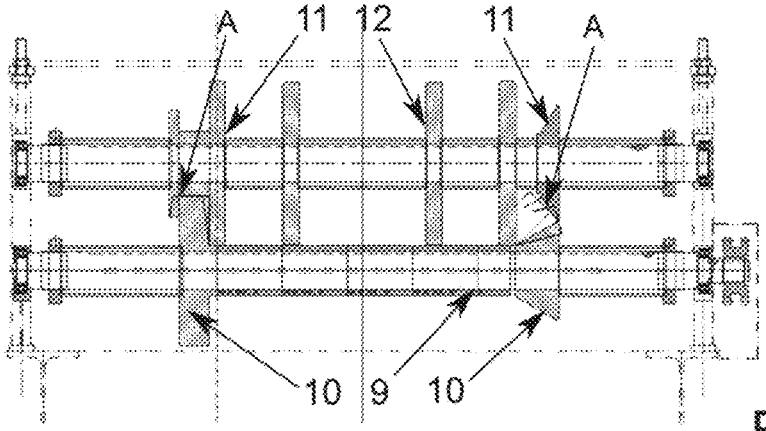
Figure 46:
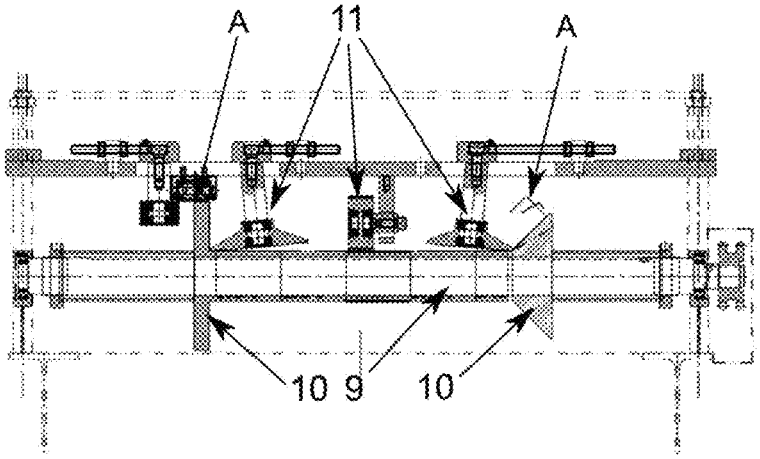
Figure 47:
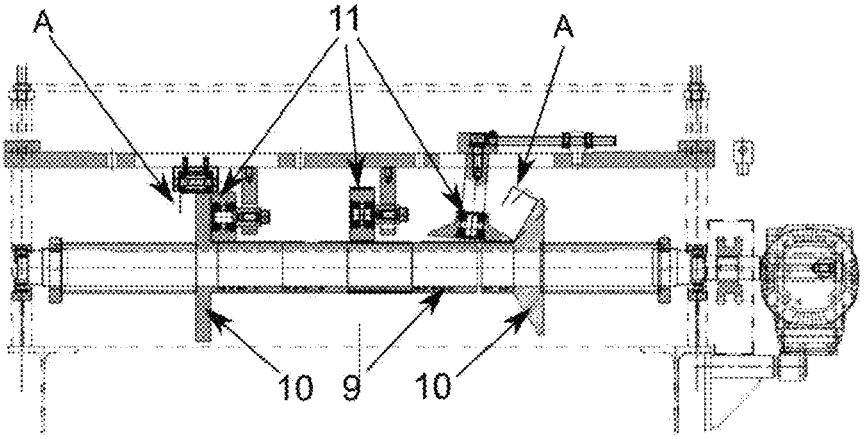
Figure 48:
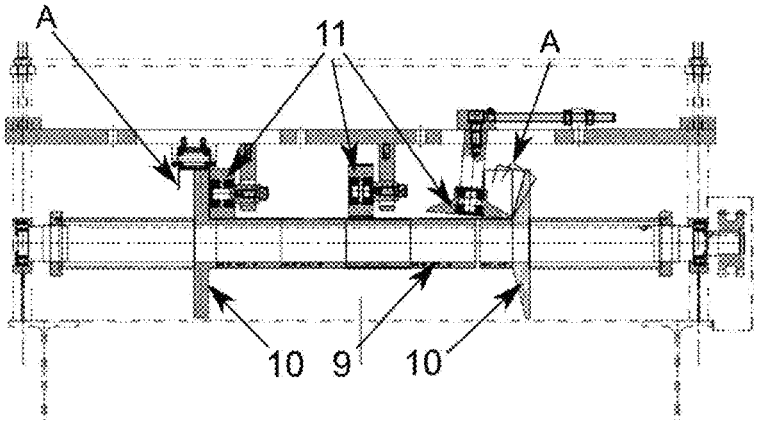
Figure 49:
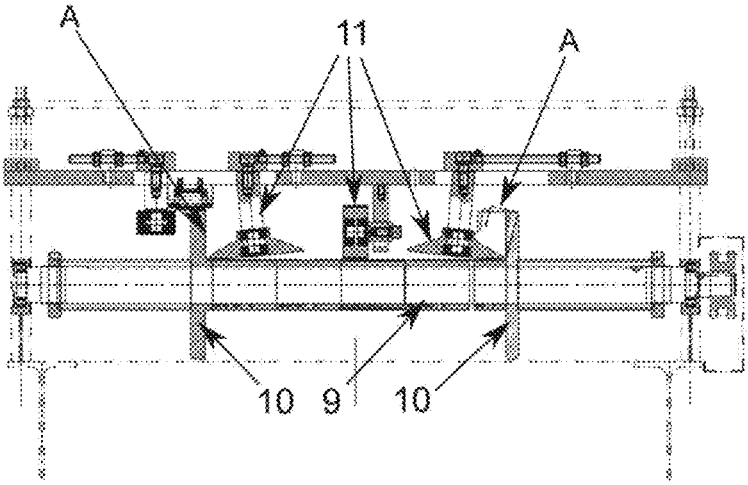
Figure 50:
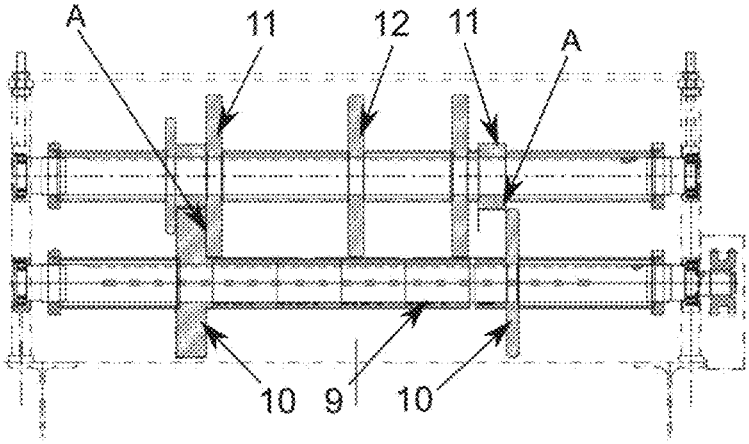
Figure 51:
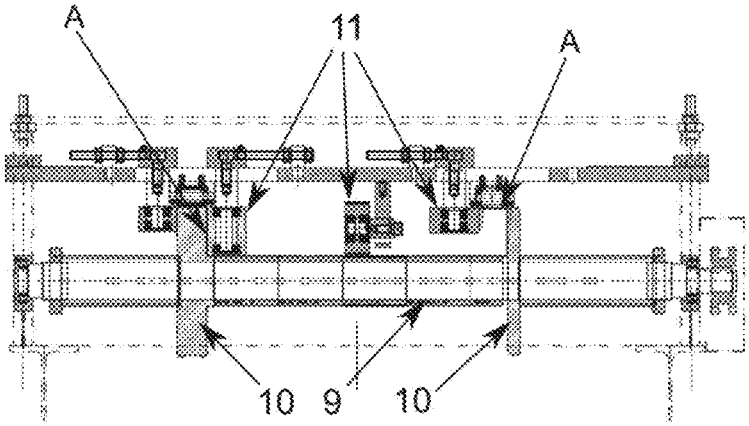
Figure 52:
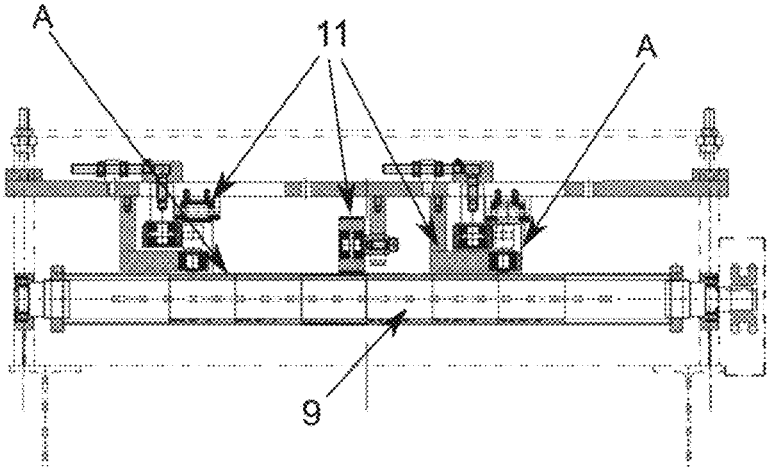
Figure 53:
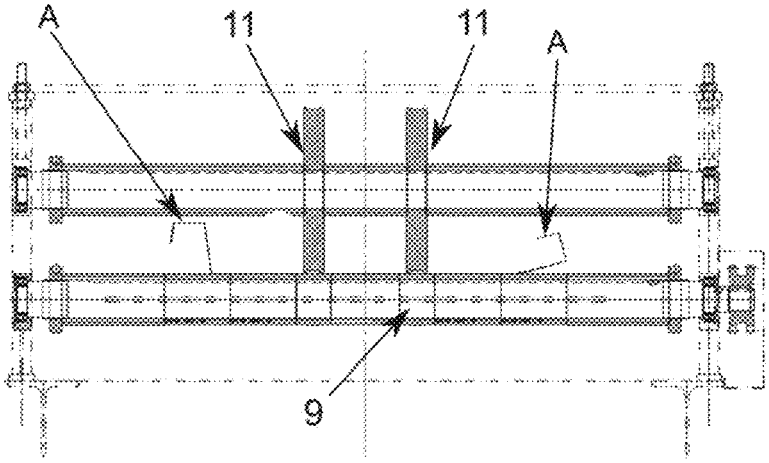

FIG. 5 a perspective view of a second metal plate, this time, open (2G), in the metal panel (1);

FIG. 6 is a top view of the first frame closed (2F), shown in FIG. 4, and fixed on the metal panel (1);

FIG. 7 is a top view of the second frame (2G) presented in FIG. 5, which is also fixed in the modular panel (1);

FIG. 8 is a side view of a plate of a coil of steel (A) next to a roll forming machine (7) that is on a table (8) that has a plurality of molding shafts (9) that support a set of support rollers (12) that are used in the method of making the closed frame (2F) of the present invention;

FIG. 9 is a cross-sectional view of step 01 of the method of making the closed frame (2F), wherein the plate of the coil of steel (A) is visualized passing through the plurality of molding shafts (9) together with the frames (10) that pass through the set of support rollers (12);

FIG. 10 is a cross-sectional view of step 02, wherein the plate of the coil of steel (A) is visualized passing through the plurality of molding shafts (9) together with the frames (10) that pass through the set of support rollers (12);

FIG. 11 is a cross-sectional view of step 03, wherein the plate of the coil of steel (A) is visualized passing through the plurality of molding shafts (9) together with the frames (10) that pass through the set of support rollers 12);

FIG. 12 is a cross-sectional view of step 04, wherein the plate of the coil of steel (A) is visualized passing through the plurality of molding shafts (9) together with the frames (10) that pass through the set of support rollers (12);

FIG. 13 is a cross-sectional view of step 05, wherein the plate of the coil of steel (A) is visualized passing through the plurality of molding shafts (9) together with the frames (10) that pass through the set of support rollers (12);

FIG. 14 is a cross-sectional view of step 06, wherein the plate of the coil of steel (A) is visualized passing through the plurality of molding shafts (9) together with the frames (10) and the set of support rollers (12);

FIG. 15 is a cross-sectional view of step 07, wherein the plate of the coil of steel (A) is visualized passing through the plurality of molding shafts (9) together with the frames (10) that pass through the set of support rollers (12);

FIG. 16 is a cross-sectional view of step 08, wherein the plate of the coil of steel (A) is visualized passing through the plurality of molding shafts (9) together with the frames (10) that pass through the set of support rollers (12);

FIG. 17 is a cross-sectional view of step 09, wherein the plate of the coil of steel (A) is visualized passing through the plurality of molding shafts (9) together with the frames (10) that pass through the set of support rollers (12);

FIG. 18 is a cross-sectional view of step 10, wherein the plate of the coil of steel (A) is visualized passing through the plurality of molding shafts (9) together with the frames (10) that pass through the set of support rollers (12);

FIG. 19 is a cross-sectional view of step 11, wherein the plate of the coil of steel (A) is visualized passing through the plurality of molding shafts (9) together with the frames (10) that pass through the set of support rollers (12);

FIG. 20 is a cross-sectional view of step 12, wherein the plate of the coil of steel (A) is visualized passing through the plurality of molding shafts (9) together with the frames (10) that pass through the set of support rollers (12);

FIG. 21 is a cross-sectional view of step 13, wherein the plate of the coil of steel (A) is visualized passing through the plurality of molding shafts (9) together with the frames (10) that pass through the set of support rollers (12);

FIG. 22 is a cross-sectional view of step 14, wherein the plate of the coil of steel (A) is visualized passing through the plurality of molding shafts (9) together with the frames (10) that pass through the set of support rollers (12);

FIG. 23 is a cross-sectional view of step 15, wherein the plate of the coil of steel (A) is visualized passing through the plurality of molding shafts (9) together with the frames (10) that pass through the set of support rollers (12);

FIG. 24 is a cross-sectional view of step 16, wherein the plate of the coil of steel (A) is visualized passing through the plurality of molding shafts (9) together with the frames (10) that pass through the set of support rollers (12);

FIG. 25 is a cross-sectional view of step 17, wherein the plate of the coil of steel (A) is visualized passing through the plurality of molding shafts (9) together with the frames (10) that pass through the set of support rollers (12);

FIG. 26 is a cross-sectional view of step 18, wherein the plate of the coil of steel (A) is visualized passing through the plurality of molding shafts (9) together with the frames (10) that pass through the set of support rollers (12);

FIG. 27 is a cross-sectional view of step 19, wherein the plate of the coil of steel (A) is visualized passing through the plurality of molding shafts (9) together with the frames (10) that pass through the set of support rollers (12);

FIG. 28 is a cross-sectional view of step 20, wherein the plate of the coil of steel (A) is visualized passing through the plurality of molding shafts (9) together with the frames (10) that pass through the set of support rollers (12);

FIG. 29 is a cross-sectional view of step 21, wherein the plate of the coil of steel (A) is visualized passing through the plurality of molding shafts (9) together with the frames (10) that pass through the set of support rollers (12);

FIG. 30 is a cross-sectional view of step 22, wherein the plate of the coil of steel (A) is visualized passing through the plurality of molding shafts (9) together with the frames (10) that pass through the set of support rollers (12);

FIG. 31 is a side view of the plate of coil of steel (A) that is next to a roll forming machine (7) that is on a table (8) that has a plurality of molding shafts (9) that support a set of support rollers (12) that are used in the method of making the open frame (2G) of the present invention;

FIG. 32 is a cross-sectional view of step 01 of the method of making the open frame (2G), wherein the plate of the coil of steel (A) is visualized passing through the plurality of molding shafts (9) together with the frames (10) that pass through the tooling (11) and the set of support rollers (12);

FIG. 33 is a cross-sectional view of step 02, wherein the plate of the coil of steel (A) is visualized passing through the plurality of molding shafts (9) together with the frames (10) that pass through the tooling (11) and the set of support rollers (12);

FIG. 34 is a cross-sectional view of step 03, wherein the plate of the coil of steel (A) is visualized passing through the plurality of molding shafts (9) together with the frames (10) that pass through the tooling (11) and the set of support rollers (12);

FIG. 35 is a cross-sectional view of step 04, wherein the plate of the coil of steel (A) is visualized passing through the plurality of molding shafts (9) together with the frames (10) that pass through the tooling (11) and the set of support rollers (12);

FIG. 36 is a cross-sectional view of step 05, wherein the plate of the coil of steel (A) is visualized passing through the plurality of molding shafts (9) together with the frames (10) that pass through the tooling (11) and the set of support rollers (12);

FIG. 37 is a cross-sectional view of step 06, wherein the plate of the coil of steel (A) is visualized passing through the plurality of molding shafts (9) together with the frames (10) that pass through the tooling (11) and the set of support rollers (12);

FIG. 38 is a cross-sectional view of step 07, wherein the plate of the coil of steel (A) is visualized passing through the plurality of molding shafts (9) together with the frames (10) that pass through the tooling (11) and the set of support rollers (12);

FIG. 39 is a cross-sectional view of step 08, wherein the plate of the coil of steel (A) is visualized passing through the plurality of molding shafts (9) together with the frames (10) that pass through the tooling (11) and the set of support rollers (12);

FIG. 40 is a cross-sectional view of step 09, wherein the plate of the coil of steel (A) is visualized passing through the plurality of molding shafts (9) together with the frames (10) that pass through the tooling (11) and the set of support rollers (12);

FIG. 41 is a cross-sectional view of step 10, wherein the plate of the coil of steel (A) is visualized passing through the plurality of molding shafts (9) together with the frames (10) that pass through the tooling (11) and the set of support rollers (12);

FIG. 42 is a cross-sectional view of step 11, wherein the plate of the coil of steel (A) is visualized passing through the plurality of molding shafts (9) together with the frames (10) that pass through the tooling (11) and the set of support rollers (12);

FIG. 43 is a cross-sectional view of step 12, wherein the plate of the coil of steel (A) is visualized passing through the plurality of molding shafts (9) together with the frames (10) that pass through the tooling (11) and the set of support rollers (12);

FIG. 44 is a cross-sectional view of step 13, wherein the plate of the coil of steel (A) is visualized passing through the plurality of molding shafts (9) together with the frames (10) that pass through the tooling (11) and the set of support rollers (12);

FIG. 45 is a cross-sectional view of step 14, wherein the plate of the coil of steel (A) is visualized passing through the plurality of molding shafts (9) together with the frames (10) that pass through the tooling (11) and the set of support rollers (12);

FIG. 46 is a cross-sectional view of step 15, wherein the plate of the coil of steel (A) is visualized passing through the plurality of molding shafts (9) together with the frames (10) that pass through the tooling (11) and the set of support rollers (12);

FIG. 47 is a cross-sectional view of step 16, wherein the plate of the coil of steel (A) is visualized passing through the plurality of molding shafts (9) together with the frames (10) that pass through the tooling (11) and the set of support rollers (12);

FIG. 48 is a cross-sectional view of step 17, wherein the plate of the coil of steel (A) is visualized passing through the plurality of molding shafts (9) together with the frames (10) that pass through the tooling (11) and the set of support rollers (12);

FIG. 49 is a cross-sectional view of step 18, wherein the plate of the coil of steel (A) is visualized passing through the plurality of molding shafts (9) together with the frames (10) that pass through the tooling (11) and the set of support rollers (12);

FIG. 50 is a cross-sectional view of step 19, wherein the plate of the coil of steel (A) is visualized passing through the plurality of molding shafts (9) together with the frames (10) that pass through the tooling (11) and the set of support rollers (12);

FIG. 51 is a cross-sectional view of step 20, wherein the plate of the coil of steel (A) is visualized passing through the plurality of molding shafts (9) together with the frames (10) that pass through the tooling (11) and the set of support rollers (12);

FIG. 52 is a cross-sectional view of step 21, wherein the plate of the coil of steel (A) is visualized passing through the plurality of molding shafts (9) together with the frames (10) that pass through the tooling (11); and FIG. 53 is a cross-sectional view that shows how the plate of the coil of steel (A) is folded after it has passed through the plurality of molding shafts (9) together with the frames (10) that pass through the tooling (11) and the set of support rollers (12).

DETAILED DESCRIPTION OF THE INVENTION

Figure 1:
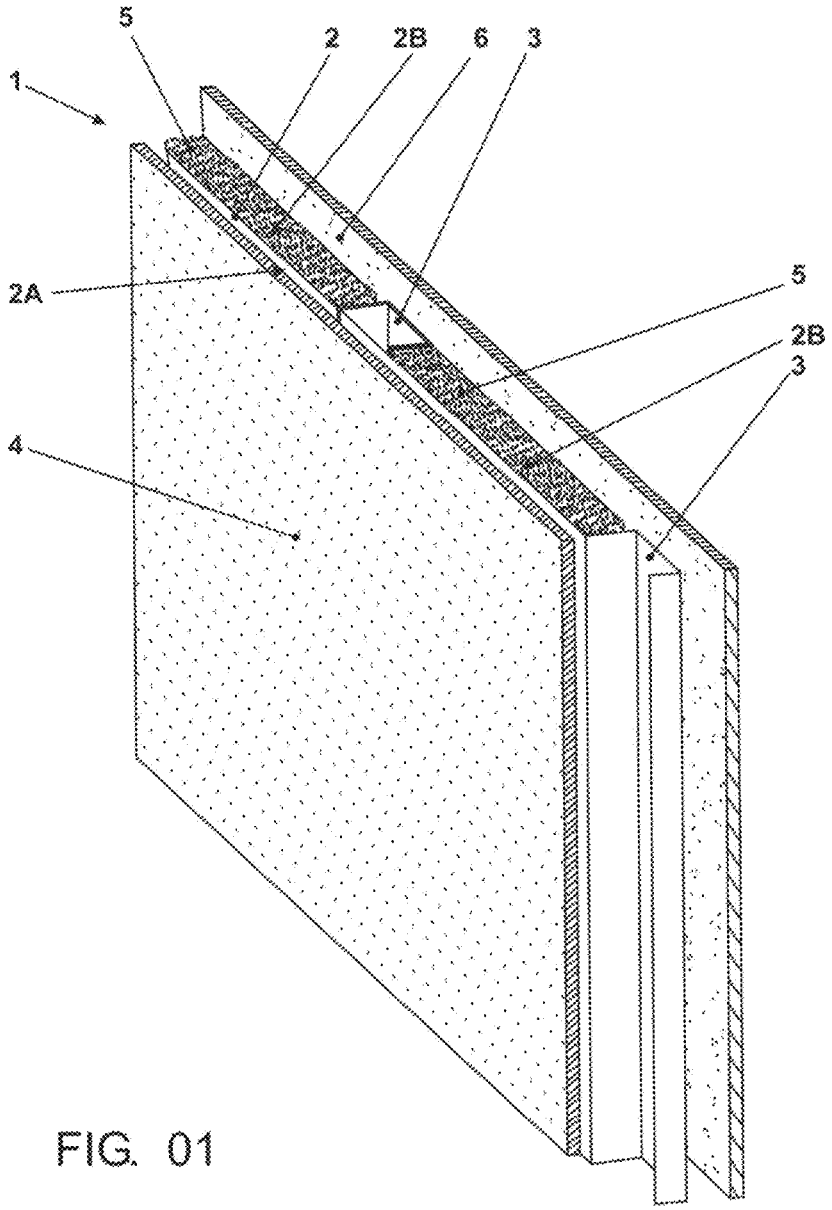
FIG. 1 is a perspective view of a metal panel (1) in which the metal frame (2) that results from the present method is adopted.

As can be seen in FIGS. 1-53, a method of making a metal frame that will be used to make metal panels that will be used to fabricate modular metal buildings. Metal panels (1) are formed from galvanized steel frames (2) that have fittings (3), said frames (2) define on their posterior surface (2A) a cementitious panel (4), and internally a thermal insulating material (5) positioned on the opposite face to the cementitious panel (4). The frames (2) are coated on their front surface (2B) of a cementitious panel (6) and define a perimeter flap (2C) that is followed by an intermediate flap (2D) that is next to a third depth flap (2E). The method of making the metal frame that will be used to make metal panels that will be used to fabricate modular metal buildings (2) comprises of 22 continuous steps that are performed by a winding machine (not represented) that is followed by a roll forming machine (7) that is on a table (8). The roll forming machine (7) has a plurality of molding shafts (9) that use a plurality of specific frames (10) that are equipped with a plurality forming tooling (11), each step uses a molding shaft of the plurality of molding shafts (9) that is connected to a support roller of the set of support rollers (12). The method for the manufacture of the closed frames (2F) is described according to the forming steps 01 to 22 begins with the placement of a steel plate of the metal coil (A) into the roll forming machine (7) that is placed on the table (8), the steel plate is shaped into the steel frame (2) according to the following sequence: steps from 01 to 04 referring to the formation of the perimeter flap (2C); stages from 05 to 12 referring to the formation of the intermediate flap (2D); and, steps 13 to 22 referring to the formation of the depth flap (2E); and lastly, cutting the steel plate with a hydraulic guillotine (not represented) to a desired size.

A Preferred method of making the open frame (2G) takes 22 steps and begins with the placement of the steel panel of the steel sheet coil (A) with its planned displacement on the table (8) suffering the set of conformation steps with the generation of the open frame (2G) according to the following sequence: steps 01 to 04 refer to the formation of the perimeter flap (2H) on the closed side; steps 05 to 12 refer to the formation of the intermediate flap (21) on the closed side; and, steps 13 to 21 refer to the formation of the depth flap (2J) on the closed side; as well as, steps 01 to 21 refer to the simultaneous formation of the flaps, perimeter (2K), intermediate (2L), and, depth (2M), on the open side of the referred frame (2G); It is also that the manufacturing process of the frame (2) allows the use of a last step with a molding shaft (9) and a forming tooling (11) for the generation of a fold next to the central surface of both the closed profile (2F) and the open profile (2G); and, the completion of the process made the cutting the steel plate with a hydraulic guillotine (not represented) to a desired size.

An advantage of the present invention is that it provides a method of manufacturing metal frames that reduces the cost of production.

Another advantage of the present invention is that it provides a method of manufacturing metal frames that is more standardized.

Yet another advantage of the present invention is that it provides metal panels, that use the metal frames that are fabricated using the present method of making the metal frames, that result in the building of stronger modular metal buildings.

Yet still another advantage of the present invention is that it provides metal frames that are easy to assemble due to their standardization.

The invention claimed is:

1. A method of making a metal frame that will be used to make metal panels that will be used to fabricate modular metal buildings, the method comprising:

providing metal panels (1) that are formed using steel frames M that have fittings (3), and said steel frames (2) define on their posterior surface (2A) a cementitious panel (4) and, internally said steel frames have a thermal insulating material (5) that is positioned on the opposite face to said cementitious panel (4); wherein that the steel frames (2) are coated on their front surface (2B) of a cementitious panel (6) and present a perimeter flap (2C), followed by an intermediate flap (2D), next to a third depth flap (2E); and taking a plate of a coil of steel (A) through 22 steps within a roll forming machine (7) that is placed on a table (8), the roll forming machine (7) has a plurality of molding shafts (9)*a* plurality of tooling (11) and a set of support rollers (12).

2. The method of making the metal frame that will be used to make metal panels that will be used to fabricate modular metal buildings of claim 1, wherein the roll forming machine has specific frames (10).

3. The method of making the metal frame that will be used to make metal panels that will be used to fabricate modular metal buildings of claim 2, wherein the metal frame made is a closed frame that is made comprising the steps of:

forming of a perimeter flap;

forming of an intermediate flap; and forming of a depth flap.

4. The method of making the metal frame that will be used to make metal panels that will be used to fabricate modular metal buildings of claim 3, comprising cutting the plate with a hydraulic guillotine.

5. The method of making the metal frame that will be used to make metal panels that will be used to fabricate modular metal buildings of claim 2, wherein the metal frame made is an open frame that is made comprising the steps of:

forming of a perimeter flap;

forming of an intermediate flap; and forming of a depth flap.

6. The method of making the metal frame that will be used to make metal panels that will be used to fabricate modular metal buildings of claim 5, comprising cutting the plate with a hydraulic guillotine.

* * * * *